US007178887B2

(12) United States Patent
Steadman

(10) Patent No.: US 7,178,887 B2
(45) Date of Patent: Feb. 20, 2007

(54) STORAGE APPARATUS

(76) Inventor: William David Steadman, 7858 Meadow Lark La., Port Saint Lucie, FL (US) 34952

( * ) Notice: Subject to any disclaimer, the term of this patent is extended or adjusted under 35 U.S.C. 154(b) by 262 days.

(21) Appl. No.: 10/467,776

(22) PCT Filed: Feb. 4, 2002

(86) PCT No.: PCT/GB02/00471

§ 371 (c)(1),
(2), (4) Date: Aug. 8, 2003

(87) PCT Pub. No.: WO02/063997

PCT Pub. Date: Aug. 22, 2002

(65) Prior Publication Data

US 2004/0066121 A1 Apr. 8, 2004

(30) Foreign Application Priority Data

Apr. 12, 2001 (GB) ..... 0103403.2

(51) Int. Cl.
*A47B 96/00* (2006.01)

(52) U.S. Cl. ..... 312/311; 312/302

(58) Field of Classification Search ..... 312/310, 312/311, 301, 298, 302, 303, 312, 319.5, 312/319.8

See application file for complete search history.

(56) References Cited

U.S. PATENT DOCUMENTS

| | | | | | |
|---|---|---|---|---|---|
| 2,196,024 | A | * | 4/1940 | North | 312/266 |
| 2,859,083 | A | * | 11/1958 | Devlin et al. | 312/298 |
| 4,700,993 | A | * | 10/1987 | Fu-Long | 312/312 |
| 4,893,885 | A | * | 1/1990 | Borello | 312/249.9 |
| 5,115,822 | A | * | 5/1992 | Nichols | 134/135 |
| 5,586,816 | A | * | 12/1996 | Geiss, II | 312/301 |
| 5,664,852 | A | | 9/1997 | Robinson | |
| 6,609,773 | B1 | | 8/2003 | Steadman | |

FOREIGN PATENT DOCUMENTS

| | | | | |
|---|---|---|---|---|
| CA | 2153364 | | 1/1997 | |
| DE | 1201019 | * | 8/1961 | 312/269 |
| FR | 2315888 | | 1/1977 | |

* cited by examiner

*Primary Examiner*—James O. Hansen
(74) *Attorney, Agent, or Firm*—Tarolli, Sundheim, Covell & Tummino LLP

(57) ABSTRACT

Storage apparatus (10) comprising a pair of storage members (54) pivotally mounted about a lifting arrangement (32). The storage members (54) and lifting arrangement (32) are locatable in a base assembly in a stored condition and can be slid outwardly and one of the members (54) raised, to provide convenient access to the respective member (54).

14 Claims, 4 Drawing Sheets

STORAGE APPARATUS

This invention concerns improvements in or relating to storage apparatus, and particularly but not exclusively storage apparatus used as kitchen cabinets.

Kitchen cabinets are often provided extending to just above floor level. Problems can be encountered by persons in reaching down to the bottom part of such cabinets to obtain items therefrom, and particularly in reaching items at the rear of such cabinets.

According to the present invention there is provided storage apparatus, the apparatus comprising a base assembly with at least one storage member movably mounted thereto, the storage member being movable between a stored condition located substantially wholly in the base assembly, and an access condition located at least partially outside of the base assembly to facilitate access to items on the storage member.

The apparatus may be arranged such that the storage member is movable to an access condition wholly outside of the base assembly. The apparatus may comprise means for raising the storage member from the access condition to an elevated condition, to further facilitate access to items on the storage member. The apparatus may be arranged such that the storage member can only be raised to the elevated condition from the access condition.

A plurality of storage members may be provided, with a selected one thereof being movable to an access condition when required.

The storage members may be rotatably mounted about a pivot, and may be rotatable to and from the access condition A pair of storage members may be provided which are desirably of substantially the same size as each other. The storage members preferably each extend for substantially 180° about the pivot, with the storage members being spaced a small distance apart.

Means may be provided to prevent the storage members rotating through more than 360° about the pivot.

The base assembly may include an opening through which the or one of the storage members is movable when moving between the stored and access conditions. The pivot may be slidably movable relative to the base assembly, to move between a first position in which the storage members are in the stored condition and a second position in which one of the storage members can be rotated to the access condition.

Contact means may be provided which only permit a storage member to be raised to the elevated condition when the storage member or a component mounted thereto, engages the contact means.

One or more closure members may be provided for closing the base assembly when the storage member or all of the storage members, are in a stored condition The apparatus may be arranged such that as the closure member or members are opened this causes the pivot to move from the first to the second position, and when the closure member or members are dosed this causes the pivot to move from the second to the first position.

The lifting means may be operatively engageable with only one storage member at any time. Means may be provided to prevent rotation of the or a storage member once raised from the access condition.

The storage member or members may comprise one or more shelves and/or drawers.

An embodiment of the present invention will now be described by way of example only and with reference to the accompanying drawings, in which.

Figure 1:
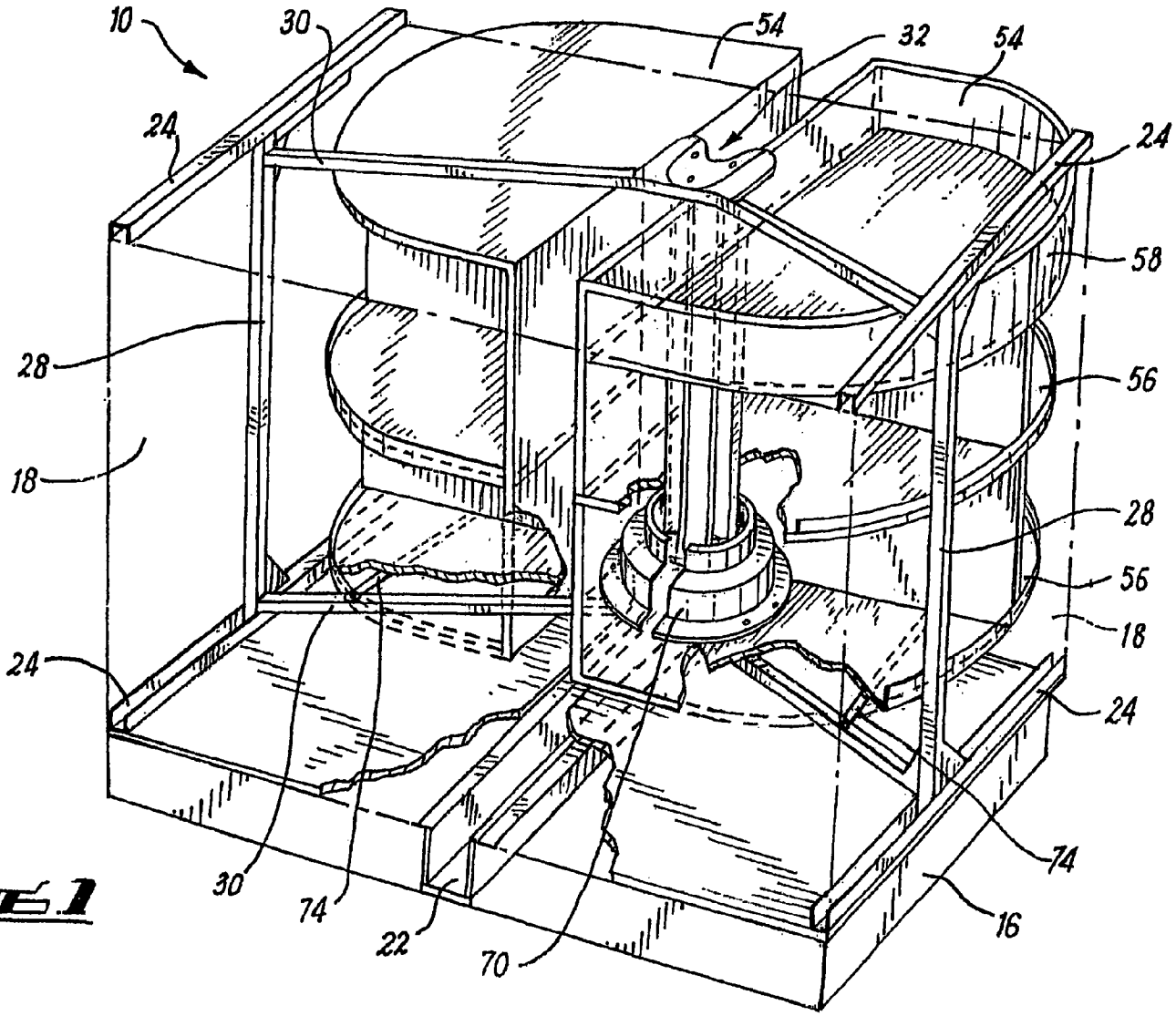
FIG. 1 is a diagrammatic perspective rear view of a storage apparatus according to the invention.

Each of the drawings show storage apparatus 10 in the form of a kitchen cupboard mountable on the floor 12 against a wall 14. The apparatus 10 comprises a base assembly including a floor part 16, side walls 18 and top wall 20 in the form of a work surface. The base assembly also comprises a pair of pivotably openable doors 21, but these have been omitted from FIGS. 1 to 3 of the drawings for clarity.

A channel 22 is provided centrally in the floor part 16 running front to back. Channel section guides 24 are provided facing upwardly from the floor part 16 at each side thereof, with corresponding downwardly facing guides 24 on the underside of the top wall 20.

A frame 26 is provided slidably mounted on the guides 24. The frame 26 comprises two forward facing C-shaped sections 28 each mounted between a respective pair of guides 24 on the floor part 16 and top wall 20. The C-shaped sections 28 are interconnected by two cross-members 30 arranged in a generally chevron shape pointing forwards. The cross-members 30 are respectively located just below the top guides 24 and just above the lower guides 24.

At the apex of the chevron of the cross-members 30 and extending therebetween and guidingly into the channel 22 is a lifting arrangement 32. The arrangement 32 comprises a motor 34 which drives via a gearbox 36 a threaded upstanding bar 38. A sleeve 40 is threadably mounted on the bar 38 by a trapped nut 42 at a lower end thereof. A tube 44 extends upwardly from the sleeve 40, and a longitudinal slot 46 is provided in the tube 44 for a purpose hereinafter to be indicated. This slot 46 extends for all but an upper part of the tube 44. The tube 44 extends through a collar 48 on a bracket 50 provided at the apex of the upper cross-member 30. A projection 52 is provided on the collar 50 which is engageable in the slot 46.

Two storage members 54 are provided which are generally semi-circular in plan view and comprise a plurality of shelves 56, with a drawer 58 being provided on one of the members 54 at an upper part. The storage members 54 are pivotally mounted about the lifting arrangement 32 so as to be selectively raisable thereby. The storage members 54 are mounted on the lifting arrangement by respective vertical lengths of channel section 60 mounted respectively centrally on a base board 62 of each storage member 54 by respective plates 63. T-shaped section elongate members 64 locate in the channel section 60 and extend between a bush 66 provided at an upper end of the sleeve 40 and a larger sleeve member 68 which extends around the sleeve 40 immediately above the gearbox 36.

A shaped recess 70 is provided in each of the storage members 54 at a lower inner part thereof. The recess 70 comprises two steps to provide a shape which encloses the motor 34 and sleeve member 68. A lifting projection 72 is provided on the sleeve 40, and engageable with an upper part of a respective one of the recesses 70. The projection 72 is pivotally movable relative to the sleeve 40 about a required limited amount.

In use, when the doors 21 are closed, the storage members 54 and lifting arrangement 32 will be wholly located within the base assembly, with the storage members 54 in a stored condition. When the doors are opened, pivoted linkages 74 which extend from each door to respectively part-way along the lower cross-member 30 on each side of the lifting arrangement 32, pull the storage members 50 and lifting arrangement 32 forward, with the latter sliding along the channel 22, to the position shown in FIGS. 1 and 2. In this position the bars 38 and 44 and hence pivotal axis of rotation of the storage members 54 is just in front of the base assembly. The storage members 54 can now be rotated relative to the lifting arrangement 32 by virtue of rotation of the bush 66 and sleeve member 68 and hence the member 64 and the channels 60.

Figure 2:
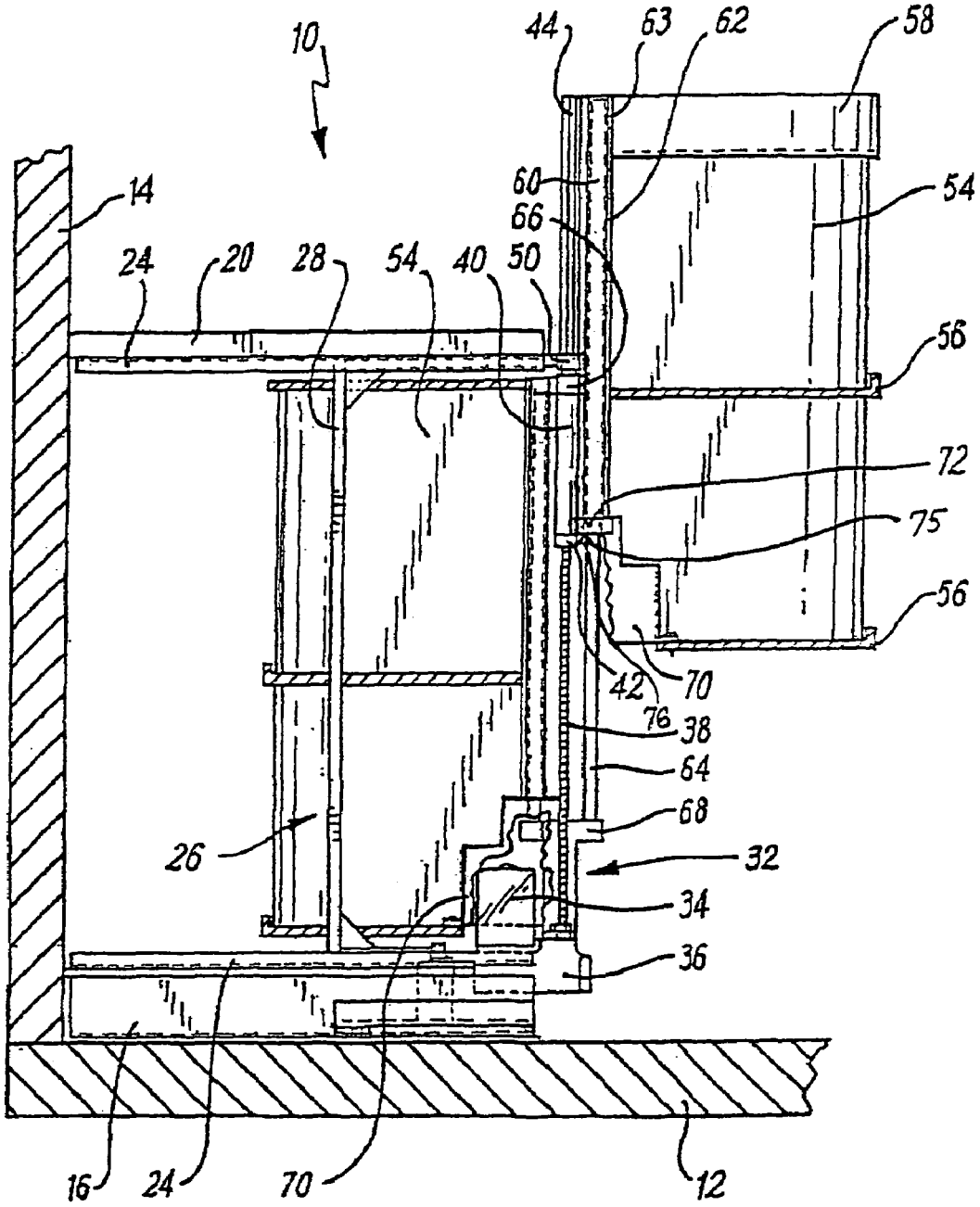
FIG. 2 is a diagrammatic side view of the apparatus of FIG. 1 in use.
Figure 3:
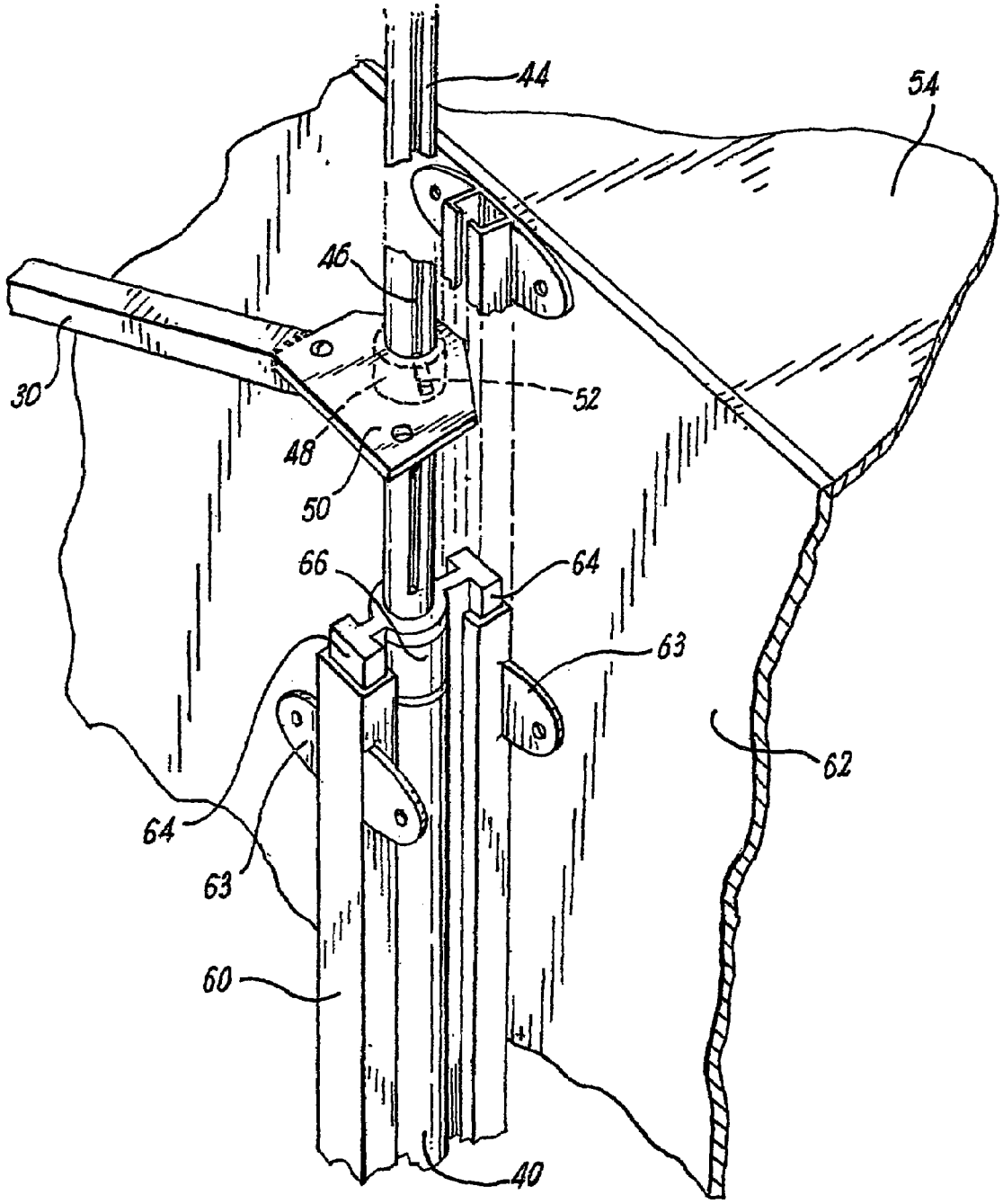
FIG. 3 is a diagrammatic perspective view of part of the apparatus of FIG. 1.
Figure 4:
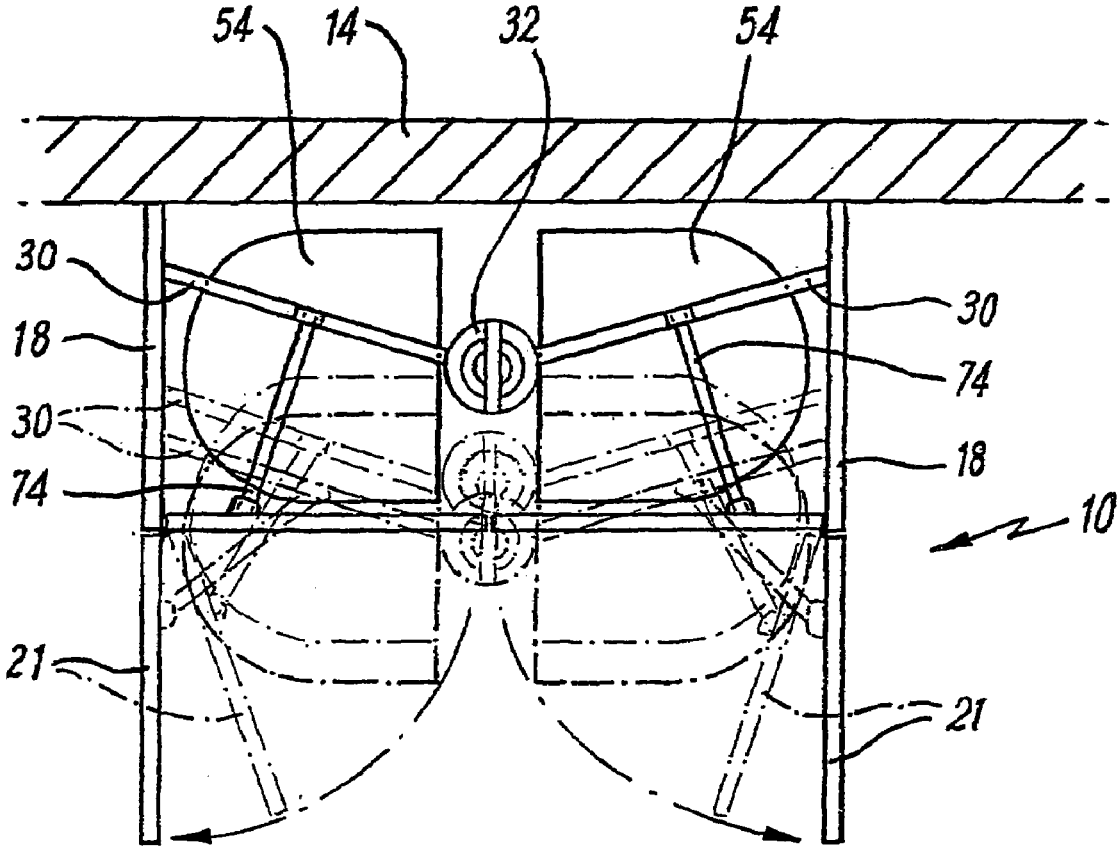
FIG. 4 is a diagrammatic plan view of the apparatus of FIG. 1.

A required storage member 54 is rotated to be in front of the base assembly in an access condition, and thus the other storage member 54 is located within the base assembly as can be seen in FIG. 2. The motor 34 is then actuated which rotates the bar 38 by the gearbox 36 to cause the sleeve 40 to rise by virtue of threaded engagement of the nut 42. The projection 72 rises with the sleeve 40 thereby raising the respective storage member 54. After the initial rise of the storage member 54 the projection 52 on the bracket 50 will engage in the slot 46 thereby preventing further rotation of the storage members 54 until the storage member 54 is again lowered. The storage member 54 can be lifted as shown in FIG. 2 to an elevated condition to provide easier access to items on the shelves 56 and in the drawer 58. The respective storage member 54 is lowered by reversing the operation, with the sleeve 40 being rotated in an opposite direction.

The projection 72 is arranged to act as an end stop with the elongate members 64 respectively engageable thereagainst such that each storage member 54 can respectively be rotated to a position to be lifted, but the storage members cannot be rotated through a full revolution. The apparatus 10 may be arranged such that a respective storage member 54 can only be raised from a fully exposed position outside of the base assembly, and forward facing. A contact surface 75 is provided on the projection 72 which must be engaged by a positioning projection 76 on the nut before the member 54 can be raised.

There is thus described a storage assembly which permits ready access to be made to items at a convenient height, yet which can provide a conventional appearance behind standard kitchen cupboard doors. The apparatus is of relatively straightforward construction and can thus be inexpensively and robustly manufactured.

It is to be realised that in some situations the raising of the storage members is not required. Accordingly, the invention also covers an arrangement with a storage member or members which can be slid outwardly of a base assembly to facilitate access thereto, and particularly to the rear of the storage member or members. Where a plurality of storage members are provided, these will also be rotatable to bring a respective one thereof to an access condition.

Various other modifications may be made without departing from the scope of the invention. For example the storage members may take a different form and it may be possible for a different number of storage members to be provided. A different lifting arrangement could be used and it may not be required for the door opening to automatically pull the lifting arrangement and storage members forward.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

The invention claimed is:

1. Storage apparatus, the apparatus comprising a base assembly having a plurality of storage members movably mounted thereto, the storage members being movable between a stored condition located substantially wholly in the base assembly, and an access condition located at least partially outside of the base assembly to facilitate access to items on the storage members, wherein one of said storage members can be raised to an elevated condition from the access condition independently of the other storage members;

the storage members being rotatably mounted about a pivot and extend for substantially 180° about the pivot, with the storage members being spaced a small distance apart;

a means to prevent the storage members from rotating through more than 360° about the pivot;

the base assembly having an opening through which the storage members are movable when moving between the stored access conditions;

the pivot being slidably movable relative to the base assembly, to move between a first position in which the storage members are in the stored condition and a second position in which one of the storage members can be rotated to the access condition;

one or more closure members is provided for closing the base assembly when the storage members, are in the stored condition; and the apparatus is arranged such that as the closure member or members are opened this causes the pivot to move from the first to the second position and when the closure member or members are closed this causes the pivot to move from the second to the first position.

2. Apparatus according to claim 1, characterized in that a storage member or members may comprise one or more shelves and/or drawers.

3. A storage apparatus capable of elevating storage members comprising:

a) a plurality of spaced storage members movable between a stored position located substantially wholly in a base assembly and a translation position located at least partially outside said base assembly;

b) a pivot assembly fixedly attached between said storage members for rotating said storage members to and from said translation position to said stored position;

c) a track from which said pivot assembly is moveably connected for allowing movement of the pivot assembly between a first position in which the storage members are in the stored position and a second position in which one of said storage members can be rotated to the translation position; and d) a lifting assembly for translating one of said storage members independently of the remaining storage members to an elevated position that facilitates access to items on the elevated storage member.

4. The storage apparatus of claim 3, wherein at least one of said remaining storage members is inside said base assembly when said one storage member is in said elevated position.

5. The storage apparatus of claim 3, wherein said lifting assembly comprises a motor and screw gear assembly.

6. The storage apparatus of claim 3, further comprising a projection attached to said lifting assembly that only permits translation to the elevated position when a selected storage member is oriented in the translation position.

7. The storage apparatus of claim 3, further comprising one or more closure members for closing said base assembly when the storage member or all of the storage members are in a stored condition, such that when the closure member or members are opened this causes the pivot assembly to move from the first to the second position and when the closure member or members are closed this causes the pivot assembly to move from the second to the first position.

8. The storage apparatus of claim 3, wherein said pivot and lifting assemblies are centrally located about the axis of rotation of the storage members, thereby minimizing stresses imposed on the storage apparatus.

9. A storage lifting apparatus for use in cabinetry comprising;

a) a plurality of spaced storage members movably located between a stored position located substantially within the base assembly and a transport position located at least partially outside of said base assembly;

b) a pivot assembly fixedly attached between and substantially located at the center of said storage members, for rotating said storage members to and from said transport position to said stored position;

c) a track from which said pivot assembly is moveably connected for allowing movement of the pivot assembly between a first position in which the storage members are in the stored position and a second position in which one of said storage members can be rotated to the transport position; and d) a lifting assembly substantially centrally located about said pivot assembly for translating one of said storage members independently of the remaining storage members to an elevated position, said lifting assembly comprising:

i) channel sections fixedly attached to said storage members;

ii) a mechanical assist for raising said channel sections; and iii) a power supply for energizing said mechanical assist, thereby translating a storage member between said transport position and said elevated position.

10. The storage lifting apparatus of claim 9, wherein said storage members include drawers and/or semi-circular shelves.

11. The storage lifting apparatus of claim 9, wherein said mechanical assist includes a screw gear and a screw follower.

12. The storage lifting apparatus of claim 9, wherein said power supply includes a motor and a gearbox.

13. The storage apparatus of claim 9, further comprising one or more closure members for closing said base assembly when the storage member or all of the storage members are in said stored position, such that when the closure member or members are opened this causes the pivot assembly to move from the first to the second position and when the closure member or members are closed this causes the pivot assembly to move from the second to the first position.

14. The storage lifting apparatus of claim 9, wherein said mechanical assist includes a collar having a projection to prevent rotation of the elevated storage member during the elevation process.

* * * * *